US009296200B2

(12) United States Patent
Benton

(10) Patent No.: US 9,296,200 B2
(45) Date of Patent: Mar. 29, 2016

(54) APPARATUS AND METHOD FOR THERMAL TRANSFER PRINTING

(71) Applicant: Markem-Imaje Corporation, Keene, NH (US)

(72) Inventor: Frances H. Benton, Keene, NH (US)

(73) Assignee: Markem-Imaje Corporation, Keene, NH (US)

( * ) Notice: Subject to any disclaimer, the term of this patent is extended or adjusted under 35 U.S.C. 154(b) by 0 days.

(21) Appl. No.: 14/839,496

(22) Filed: Aug. 28, 2015

(65) Prior Publication Data

US 2015/0367627 A1 Dec. 24, 2015

Related U.S. Application Data

(63) Continuation of application No. PCT/US2014/059293, filed on Oct. 6, 2014, which is a continuation of application No. 14/050,054, filed on Oct. 9, 2013, now Pat. No. 8,922,611.

(51) Int. Cl.
*B41J 2/325* (2006.01)
*B41F 31/02* (2006.01)

(52) U.S. Cl.
CPC ..... *B41F 31/027* (2013.01)

(58) Field of Classification Search
USPC ..... 347/101–106, 171, 172, 175, 212, 213, 347/215, 217
See application file for complete search history.

(56) References Cited

U.S. PATENT DOCUMENTS

| | | | |
|---|---|---|---|
| 3,731,649 | A | 5/1973 | Anderson |
| 4,253,775 | A | 3/1981 | Crooks |
| 4,268,368 | A | 5/1981 | Aviram |
| 4,421,429 | A | 12/1983 | Graham |
| 4,462,035 | A | 7/1984 | Koto |
| 4,707,155 | A | 11/1987 | Burkhead |
| 4,824,514 | A | 4/1989 | Schneider |
| 5,019,836 | A | 5/1991 | Iwata |
| 5,054,943 | A | 10/1991 | Cheng |

(Continued)

FOREIGN PATENT DOCUMENTS

| | | | |
|---|---|---|---|
| DE | 10051850 | A1 | 10/2001 |
| EP | 0182011 | A3 | 1/1988 |

(Continued)

OTHER PUBLICATIONS http://en.wikipedia.org/wiki/Kapton, Kapton, downloaded Aug. 26, 2013, 3 pages.

(Continued)

*Primary Examiner* — Kristal Feggins
(74) *Attorney, Agent, or Firm* — Fish & Richardson P.C.

(57) ABSTRACT

Methods, systems, and apparatus, including medium-encoded computer program products, for thermal transfer printing include, in at least one aspect, a printing apparatus includes: a band capable of holding hot melt ink thereon; rollers configured and arranged to hold and transport the band with respect to a substrate; a printhead configured and arranged to thermally transfer a portion of the ink from the band to the substrate to print on the substrate; and a heating device configured and arranged to heat the band to cause ink on the band to re-melt, flow and replace at least some of the portion of the ink transferred to the substrate previously before arriving at the printhead again for a next print.

20 Claims, 4 Drawing Sheets

(56) References Cited

U.S. PATENT DOCUMENTS

| | | | | |
|---|---|---|---|---|
| 5,137,382 | A | 8/1992 | Miyajima | |
| 5,316,885 | A | 5/1994 | Sasaki | |
| 5,336,000 | A | 8/1994 | Handa | |
| 5,746,522 | A | 5/1998 | Moreland | |
| 5,865,115 | A | 2/1999 | Fassler | |
| 6,128,464 | A | 10/2000 | Taniguchi | |
| 6,133,931 | A * | 10/2000 | Yoshikawa | B41J 2/325 347/213 |
| 6,396,528 | B1 * | 5/2002 | Yanagawa | G03G 15/344 347/213 |
| 6,704,037 | B1 * | 3/2004 | Taguchi | B41J 2/325 347/213 |
| 6,801,236 | B2 * | 10/2004 | Araki | B41F 19/062 347/213 |
| 7,639,269 | B2 | 12/2009 | Mizukami | |
| 7,675,533 | B2 * | 3/2010 | Tamura | B41J 2/325 347/213 |
| 8,137,015 | B2 | 3/2012 | Noda | |
| 8,231,935 | B2 | 7/2012 | Ihara | |
| 8,668,396 | B2 | 3/2014 | Ihara | |
| 2004/0223043 | A1 | 11/2004 | Araki | |
| 2012/0086763 | A1 | 4/2012 | McNestry | |
| 2012/0236089 | A1 | 9/2012 | Iftime | |
| 2013/0039685 | A1 | 2/2013 | Starkey | |

FOREIGN PATENT DOCUMENTS

| | | | |
|---|---|---|---|
| EP | 417488 | B1 | 10/1993 |
| FR | 2544666 | B1 | 4/1986 |
| JP | S6195961 | A | 5/1986 |
| JP | 61221046 | A | 10/1986 |
| JP | H03213357 | A | 9/1991 |
| JP | H4235080 | A | 8/1992 |
| JP | H054456 | A | 1/1993 |
| JP | H06155857 | A | 6/1994 |
| JP | H8230339 | A | 9/1996 |
| JP | H1034988 | A | 2/1998 |
| WO | WO0232684 | A1 | 4/2002 |

OTHER PUBLICATIONS http://en.wikipedia.org/wiki/Thermal_transfer_printing, "Thermal transfer printing", downloaded Sep. 24, 2013, 2 pages.

Notification of Transmittal of the International Search Report and the Written Opinion of the International Searching Authority, International Application No. PCT/US14/59293, mailed Jan. 2, 2015, 8 pages.

* cited by examiner

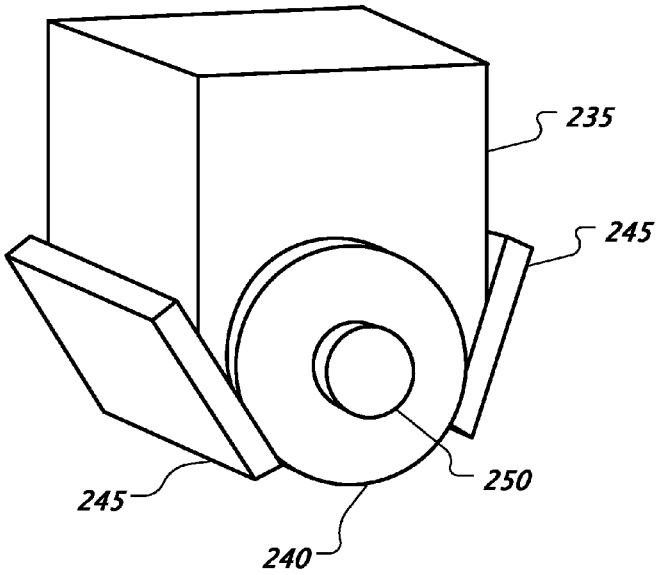
Fig. 2B
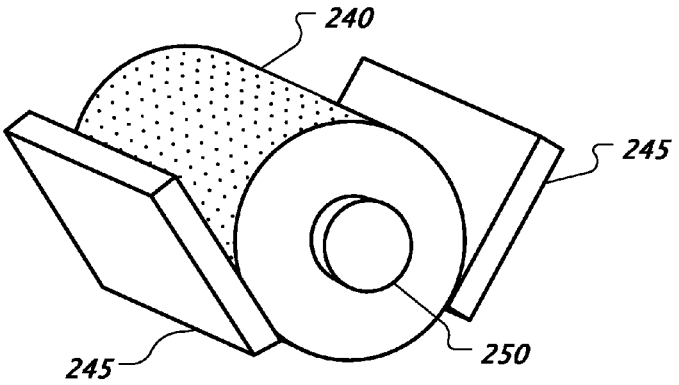
Fig. 2C
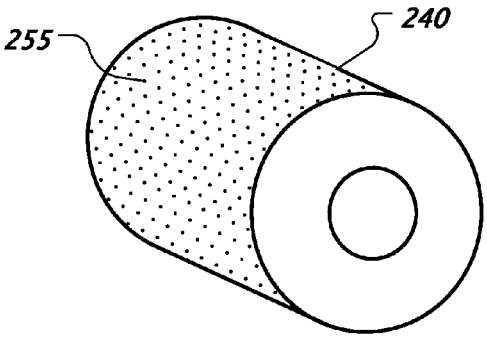
Fig. 2D
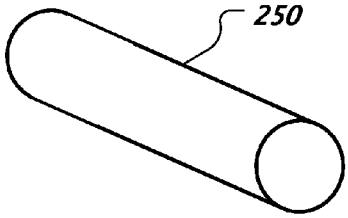

APPARATUS AND METHOD FOR THERMAL TRANSFER PRINTING

CROSS-REFERENCE TO RELATED APPLICATIONS

This application is a continuation application and claims the benefit of priority under 35 USC 120 to International Application PCT/US2014/059293, filed Oct. 6, 2014, which claims priority to U.S. patent application Ser. No. 14/050,054, filed Oct. 9, 2013, and issued as U.S. Pat. No. 8,922,611 on Dec. 30, 2014.

BACKGROUND

This specification relates to systems and techniques for thermal transfer printing.

Thermal transfer printing involves the use of a ribbon to carry a material (e.g., ink) to the location of a printhead, where heat is then used to transfer the material from the ribbon to a substrate (e.g., paper or plastic). Many different variations of this general process have been developed over the last sixty years, and various improvements have also been made in the configurations and control systems employed for thermal transfer printers. For example, U.S. Patent Pub. No. 2013/0039685 describes a motor control system, a method of operating a motor control system, a tape drive including a motor control system, a method of operating such a tape drive, and a printing apparatus including such a tape drive, as can be used with thermal transfer printing.

In spool-to-spool printers, ink is supplied in ribbon form rolled onto cores, which are mounted or pressed onto spools (a supply spool and a take-up spool) in the printer. The movement of the spools can be precisely controlled by an electric motor for each spool. During a standard print operation, the motors are controlled to move the ribbon in front of the printhead at the same speed as the substrate where ink is removed from the ribbon. In order not to waste ribbon, each print should land on the ribbon directly adjacent to the previous print. This typically requires backing up the ribbon between each print in order to allow enough space on the ribbon to accelerate the ribbon to match the substrate speed before printing. For each print, both motors are used to accelerate the ribbon to the substrate speed, move the ribbon forward at the print speed, decelerate to zero velocity, accelerate in the reverse direction, stop and then decelerate again in the reverse direction, stop and then start the entire process over again for the next print. All of this is often complicated by the fact that the diameters of both spools are changing as the supply side is used up and the take-up side grows. Similar limitations apply to traditional shuttled printers, where the pack rate is limited by the operations of the shuttle, which goes back and forth for each print, and the length of the print may be limited by the travel distance of the shuttle.

SUMMARY

This specification describes technologies relating to systems and techniques for thermal transfer printing.

In general, one or more aspects of the subject matter described in this specification can be embodied in one or more methods that include: transporting a band holding hot melt ink thereon in proximity to both a heating device and a thermal transfer printhead, where the thermal transfer printhead is adjacent a substrate; actuating heaters in the thermal transfer printhead to transfer a portion of the ink from the band to the substrate to create a print on the substrate; and operating the heating device to heat the band to cause ink on the band to re-melt, flow and replace at least some of the portion of the ink transferred to the substrate previously before arriving at the printhead again for a next print. Other embodiments of this aspect include corresponding systems, apparatus, and computer program products.

Operating the heating device can include: using a heater to maintain a temperature of a solid heat conducting material of an ink roller, where the solid heat conducting material includes a textured outer surface; applying a first side of the solid heat conducting material of the ink roller to the band to re-melt ink on the band; and supplying new ink to a second side of the solid heat conducting material of the ink roller, such that the new ink is retained by the textured outer surface. The textured outer surface of the ink roller can have a surface roughness greater than or equal to 3.2 microns, and the method can include using a blade to control an amount of ink retained by the textured outer surface of the ink roller, such that a uniform coating of ink, between 3 and 7 microns thick, is applied to the band.

The supplying can include periodically putting solid ink in contact with the textured outer surface of the ink roller. The transporting can include continuously moving the band at a same speed as the substrate, in coordination with the actuating, to achieve a pack rate above 650 packs per minute. The method can include: moving the thermal transfer printhead from a non-printing position into a printing position against the band to press the band against the substrate before the actuating; and moving the thermal transfer printhead back into the non-printing position after the actuating. Moreover, the band can include a polyimide film, an engineering plastic, or a metal ribbon.

One or more aspects of the subject matter described in this specification can be embodied in one or more printing apparatus including: a band capable of holding hot melt ink thereon; rollers configured and arranged to hold and transport the band with respect to a substrate; a printhead configured and arranged to thermally transfer a portion of the ink from the band to the substrate to print on the substrate; and a heating device configured and arranged to heat the band to cause ink on the band to re-melt, flow and replace at least some of the portion of the ink transferred to the substrate previously before arriving at the printhead again for a next print.

The heating device can include an ink roller including a solid heat conducting material having an outer surface that is textured, where the textured outer surface of the ink roller can be configured and arranged to contact the band and to receive new ink on the textured outer surface, and the textured outer surface of the ink roller can have a surface roughness greater than or equal to 3.2 microns. The ink roller can have a heater, and the printing apparatus can include: a blade configured and arranged to control an amount of ink retained by the textured outer surface of the ink roller; and a reservoir configured and arranged to hold any excess ink proximate to the ink roller.

The ink roller can be configured and arranged to apply a uniform coating of ink, between 3 and 7 microns thick, to the band. The printing apparatus can include a device to periodically put solid ink in contact with the textured outer surface of the ink roller to cause ink to be melted into the textured outer surface of the ink roller. One of the rollers can be a drive roller, and another of the rollers can be a spring loaded tension roller. The printing apparatus can also include a control system configured to control the band to match a speed of the substrate and to print at a pack rate above 650 packs per minute.

The band can include a polyimide film, such as a Kapton® material. The band can include an engineering plastic, such as an engineering plastic having a heat transfer rate greater than 0.120 Watts/meter-Kelvin and a thickness less than 25 microns. The band can include a metal ribbon, such as a stainless steel ribbon. Other band materials are also possible.

Particular embodiments of the subject matter described in this specification can be implemented to realize one or more of the following advantages. High speed and high pack rate thermal transfer printing can be realized while also minimizing use of consumables, such as used thermal transfer ribbon spools. High speed, high pack rate, and high quality coding can be performed on flexible films, as may be used in the flow-wrapper market. A thermal transfer printer can include an inkable band that is re-inked within the printer, where the band can be transported at the rate of the substrate to be printed to achieve very high pack rates. However, even when lower printing rates are used, the advantage of waste reduction still remains, which can result in reduced costs. The ribbon waste (ribbon substrate material, unused ink left on the ribbon (note that typical prints use about 30% of the ink in the area of the print), and used cores) of traditional spool-to-spool type thermal transfer printers can be substantially eliminated.

Printer down time can also be reduced since ink supplies can be replenished without stopping the line, and the band can be durable enough to require infrequent replacement (e.g., substantially less often than replacement of an ink ribbon roll). Moreover, since the band length does not change, tension in the band can be readily maintained using a spring loaded roller or dancer arm. A feedback loop to the controller need not be included to monitor the band tension or length. Only one motor need be used to move the mass of the band in one direction, rather than two motors traditionally used to drive two spools, forward and backward, where those two motors should accelerate and decelerate the mass of a full ribbon roll without losing position. The durability of the band, the replacement of only the ink used, and the lack of a ribbon core have the added advantage of reduced costs for the customer.

The details of one or more embodiments of the subject matter described in this specification are set forth in the accompanying drawings and the description below. Other features, aspects, and advantages of the invention will become apparent from the description, the drawings, and the claims.

BRIEF DESCRIPTION OF THE DRAWINGS

FIG. 2B shows an example of components of the thermal transfer printing apparatus from FIG. 2A.

FIG. 2C shows further details of the example of components from FIG. 2B.

FIG. 2D shows an exploded view of components from FIG. 2C.

Like reference numbers and designations in the various drawings indicate like elements.

DETAILED DESCRIPTION

Figure 1:
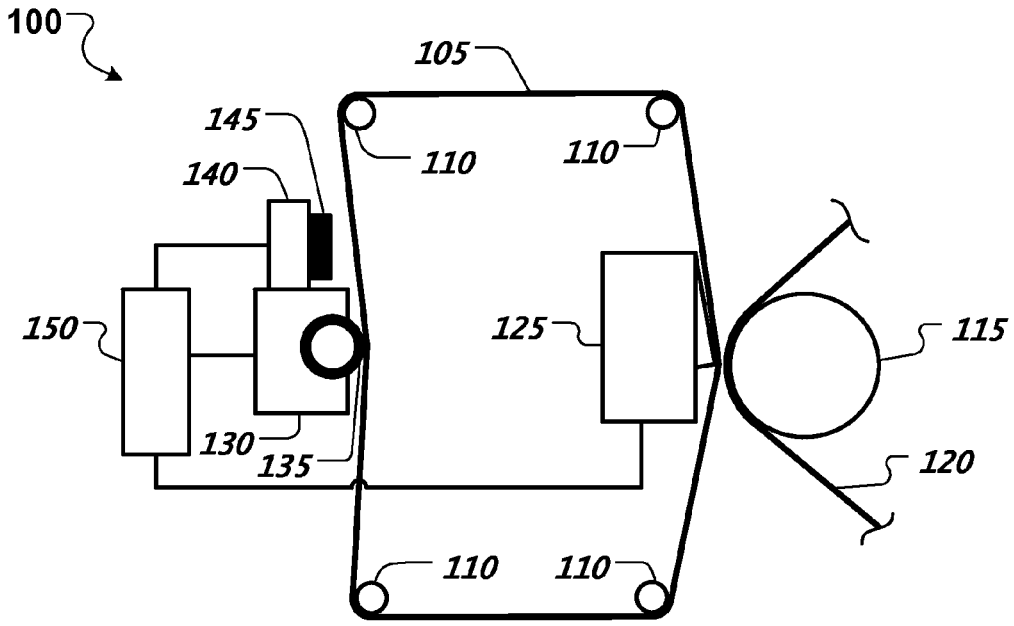
FIG. 1 shows an example of a thermal transfer printing system.

FIG. 1 shows an example of a thermal transfer printing system 100. The system 100 includes a band 105 entrained around rollers 110. The band can be made of various materials, such as polyimide film, engineering plastic, or metal. Selection of an appropriate thickness for a given type of band material can result in good heat transfer characteristics through the band 105, allowing high quality prints at high speed, while also maintaining the durability of the band 105. A print roller 115 can be used to transport a substrate 120 (e.g., paper or plastic) proximate to the band 105. A thermal transfer printhead 125 is adjacent to the substrate 120 and is used to transfer hot melt ink from the band 105 to the substrate 120. In some implementations, the system 100 can be reconfigured to position the substrate 120 adjacent the printhead 125 on a platen, rather than a roller 115.

A heating device 130 is positioned adjacent to the band 105 so as to heat and re-ink the band 105. For example, the heating device 130 can include an ink roller 135 that resides at least partially within a reservoir that holds ink for the thermal transfer printing system 100. In addition, the system can include a device 140 that periodically adds new ink. For example, the device 140 can periodically put solid ink 145 in contact with the ink roller 135 to cause ink to be melted onto the outer surface of the ink roller 135, with any excess being retained in the reservoir. Note that the roller 135 can be heated such that contact by the solid ink 145 will readily melt new ink for the system 100, similar to what would happen when touching a hot skillet with a crayon. In other implementations, the reservoir can be filled with molten or semi-solid ink that is then in contact with one portion of the roller 135, or a foam or sponge roller can be impregnated with hot melt ink and put in contact with the heated ink roller 135 (e.g., with the pressure of the foam or sponge roller against the heated roller maintaining the proper amount of ink in pockets of the heated roller). In some implementations, the ink is a mixture of pigment, wax and resin for a total pigment concentration of 20%, although many wax and resin type hot melt inks can be used in various implementations.

A controller 150 can also be provided to operate the various components of the system 100, including the printhead 125, the heating device 130, and the ink supply device 140. The controller 150 can be implemented using special purpose logic circuitry or appropriately programmed processor electronics. For example the controller 150 can include a hardware processor and software to control the system 100, including controlling the speed of the band 105 to match the speed of the substrate 120, and the delivery of data to the printhead 125. The data can be delivered digitally, and the data can be changed with each print while the band and substrate continue to move at the same speed (e.g., 3 m/s).

The controller 150 can include (or be coupled with) one or more sensors to assist in carrying out its functions. Moreover, the controller 150 can be divided into various subcomponents, which can be then be integrated together to operate in cooperation with each other, or separately control the components of the system 100. In some implementations, the controller 150 can control the band speed to enable the printer to operate at the high end speeds used by HFFS (Horizontal Form Fill and Seal) machinery. For example, the target substrate speed can be three meters per second, and the target pack rate can be 600 packs per minute (ppm) or greater. Note that a relatively simple motor driver system can be used to operate the band 105 at the same speed as the print roller 115 during printing. For example, a rotary encoder can be put in contact with the print roller 115, and a stepper motor can be used to drive the band 105. A belt and pulley from the motor can be used to drive the ink roller 135. In some implementations, a gear or belt arrangement from the print roller 115 can be used to drive the band 105 at the same speed as the print roller 115 without using a motor.

Figure 2A:
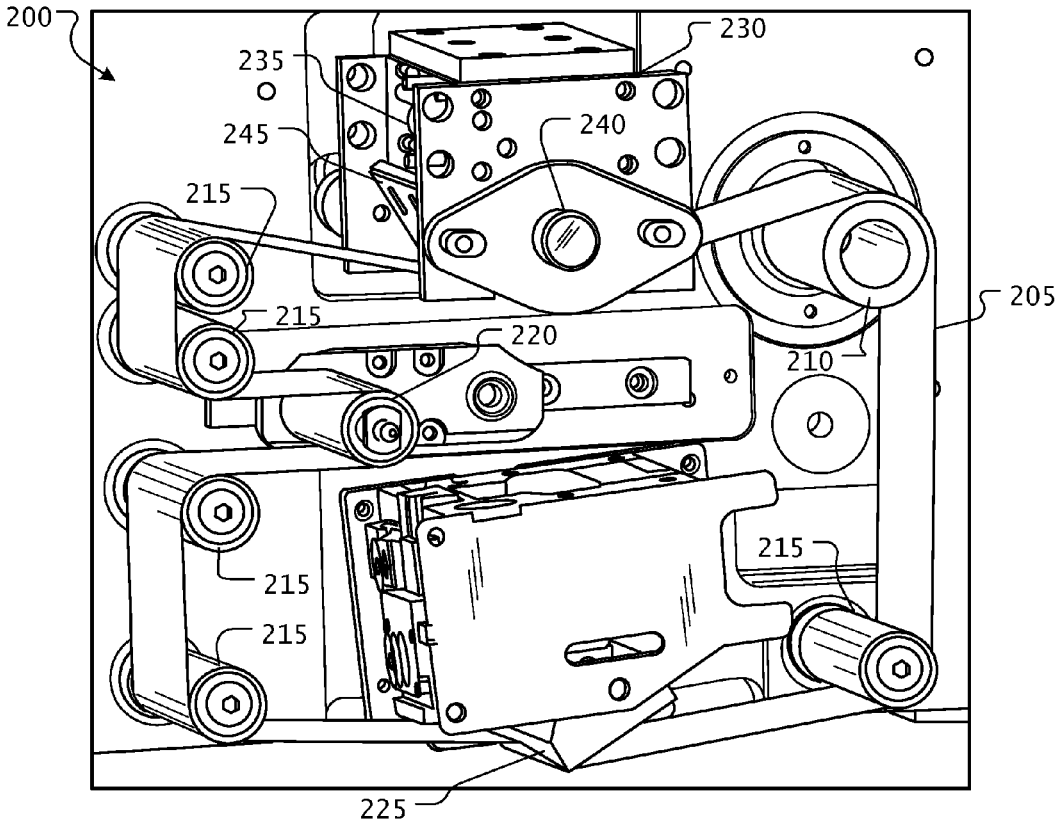
FIG. 2A shows an example of a thermal transfer printing apparatus.

FIG. 2A shows an example of a thermal transfer printing apparatus 200. The thermal transfer printing apparatus 200 includes a band 205, which can include materials such as described above in connection with FIG. 1. For example, the band 205 can be a polyimide film with a thickness of 7.5 microns. In some implementations, the polyimide film is a Kapton® material, available from E. I. du Pont de Nemours and Company of Wilmington Del. In some implementations, the band 205 can be an engineering plastic that has a heat transfer rate greater than 0.120 Watts/meter-Kelvin and a thickness less than 25 microns (e.g., 4.5 microns). In some implementations, the band 205 can be a metal such as stainless steel ribbon with a thickness of 10 microns or less, such as 5 microns.

The band 205 is held and transported using rollers, which include a drive roller 210, routing rollers 215, and a spring loaded tension roller 220. These rollers carry the band 205 to a thermal printhead 225 and an ink delivery device 230. The ink delivery device 230 includes a reservoir 235 to hold any excess ink proximate to an ink roller 240. The ink delivery device 230 also includes a blade 245 to control an amount of ink retained by the ink roller 240. The ink is applied to the band 205 as the band 205 contacts the roller 240. In some implementations, the ink coating applied to the band 205 is a uniform coating between three and seven microns thick. In some implementations, the ink delivery device 230 has a removable top to give access to the reservoir 235, which includes a slot for ink that is put in contact with the roller 240 within the reservoir 235.

In some implementations, a DC motor can be used to revolve the heated roller 240 to match the band speed to the substrate speed. In some implementations, the heated roller 240 is connected to a motor that is computer controlled to match the band speed to the substrate speed. In some implementations, the motor is connected with pulleys and belts to the drive roller 210 and the heated roller 240. In addition, the band 205 can be kept at approximately 6 Newtons of tension, such as by looping the band around the spring loaded tension roller 220, which is attached to a linear slide, as shown.

The ink delivery device 230 can also be viewed as a heating device. In some implementations, the ink delivery device 230 can include a heater within the reservoir 235. In some implementations, the ink delivery device 230 can include a heater within the heated roller 240, which is part of the ink delivery device 230. FIG. 2B shows an example of components of the thermal transfer printing apparatus from FIG. 2A. FIG. 2C shows further details of the example of components from FIG. 2B. FIG. 2D shows an exploded view of components from FIG. 2C. An ink roller 240 is partially contained by the reservoir 235. The ink roller 240 can be a solid heat conducting material having an outer surface that is textured 255. For example the texture 255 can be formed by bead blasting (e.g., using ceramic beads) to create a pocketed surface on the roller 240. In some implementations, the roller 240 can be a knurled roller or an anilox roll or gravure cylinder with a specific design for coating. In any case, the textured outer surface 255 of the roller 240 can be designed to receive new ink from the reservoir or from direct contact with solid ink, such as described above. For example, the textured outer surface 255 of the ink roller 240 can have a surface roughness greater than or equal to 3.2 microns (e.g., approximately 3.2, 6.3, or 12.5 micrometer surface finish). In some implementations, the roller 240 can be a wire wound roller, such as a K-bar as provided by RK Printhcoat Instruments of Litlington, Royston, UK.

Two blades 245 can be positioned on either side of the roller 240 to control an amount of ink retained by the textured outer surface 255 of the roller 240. The blades 245 can be made from silicone. Stainless steel plates can support the silicone blades. One of the blades 245 can be used to doctor the ink, and the other blade 245 can be used to keep debris from rolling back into the ink in the reservoir.

The roller 240 can be heated and positioned to contact the band, such that ink on the band is re-melted as the band passes the roller 240. The roller 240 can include a heater 250 within a center portion of the roller 240, which can be operated to keep the roller 240 at an appropriate temperature to re-melt the ink on the band as it passes the roller 240. For example, the ink can be a wax based ink with twenty percent carbon concentration, and the roller 240 can be kept at a temperature of about 80° C. to keep the ink at a tacky consistency able to coat the roller without becoming so liquid that it flows off the roller. The heater 250 inside the roller 240 can be powered using wires connected through a slip ring (rotating electrical connector) so the heater can rotate with the roller. For example, a rotary electrical connector, such as a 4 connector Mercotac Model 430, can be used for connecting to the heater and to a sensitive thermocouple for feedback signals to provide power to the heater. Other heating systems can also be used, such as heating the roller 240 from the outside using radiant heat (e.g., a heater placed within the reservoir proximate to the roller).

Figure 3:
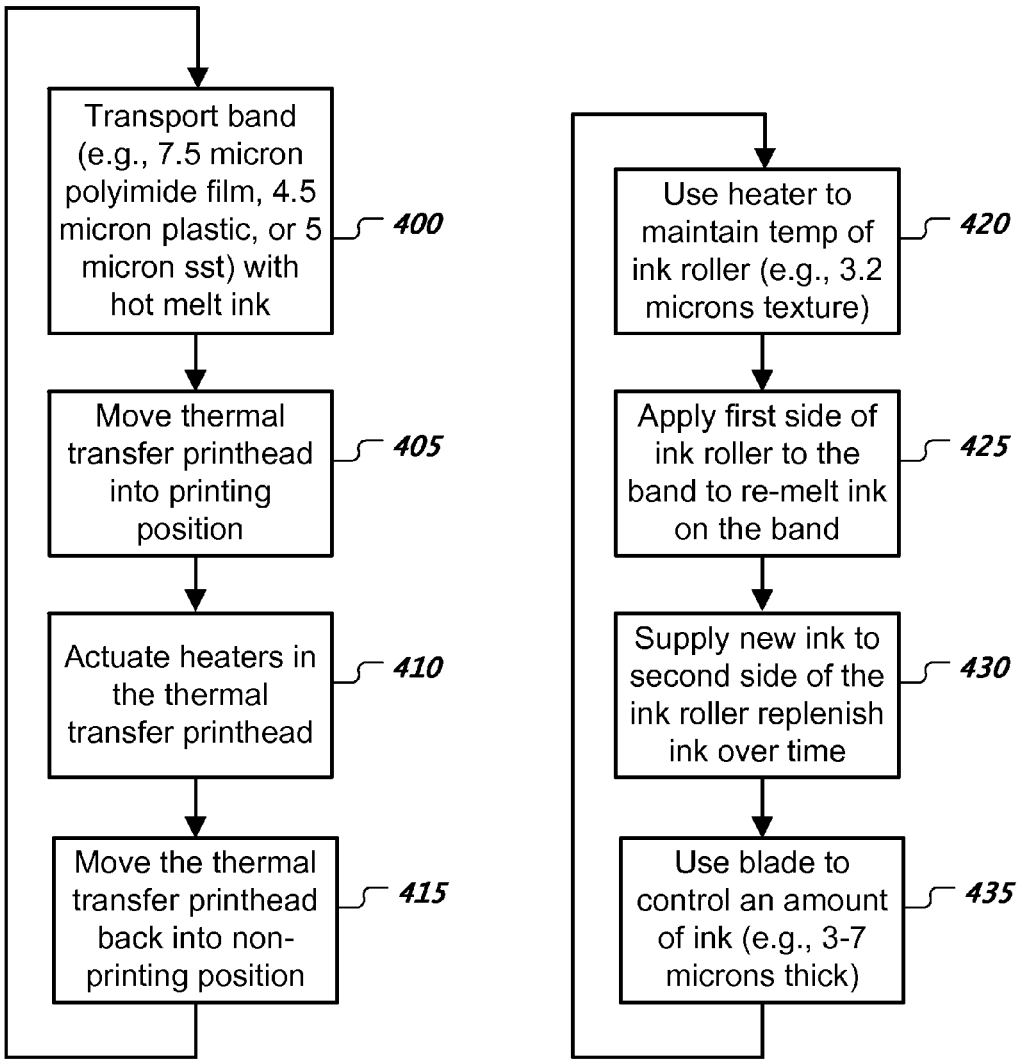
FIG. 3 shows an example of a process for operating a thermal transfer printer.

FIG. 3 shows an example of a process for operating a thermal transfer printer. At 400, a band holding hot melt ink thereon is transported in proximity to both a heating device and a thermal transfer printhead adjacent a substrate. For the printhead side of the band, in some implementations, the thermal transfer printhead can be moved at 405 from a non-printing position into a printing position against the band to press the band against the substrate. This can be done using a pneumatic cylinder, a motor and a cam, or by another mechanism. As described above, the band can include a polyimide film, an engineering plastic, or a metal ribbon.

At 410, heaters in the thermal transfer printhead are actuated to transfer a portion of the ink from the band to the substrate to create a print on the substrate. Ink is melted off the band and onto the substrate in accordance with instructions from a control system. At 415, the thermal transfer printhead can be moved back into the non-printing position after the actuating.

For the heating device side of the band, the heating device is operated to heat the band to cause ink on the band to re-melt, flow and replace at least some of the portion of the ink transferred to the substrate previously before arriving at the printhead again for a next print. In some implementations, a heater is used at 420 to maintain a temperature of a solid heat conducting material of an ink roller, where the solid heat conducting material includes a textured outer surface. The maintained temperature can be between 70° and 90° C., or another temperature range, or a temperature value, dependent upon the printing material being used in a specific implementation. At 425, a first side of the solid heat conducting material of the ink roller is applied to the band to re-melt ink on the band. As each portion of the band moves past the inked heated roller, the ink on the band is re-melted.

In addition, new ink can be supplied at 430 to a second side of the solid heat conducting material of the ink roller, such that the new ink is retained by the textured outer surface. For example, this can involve periodically putting solid ink in contact with the textured outer surface of the ink roller, as described above. The textured outer surface of the ink roller can have a surface roughness greater than or equal to 3.2 microns. Further, a doctor blade can be used at 435 to control an amount of ink retained by the textured outer surface of the ink roller, e.g., ink contained by pockets on the roller, such that a uniform coating of ink, between 3 and 7 microns thick, is applied to the band. Areas on the band that have had ink removed in the printing process are thus recoated with melted ink through contact with the roller. Ink is supplied to the roller both by re-melting the ink already on the band in contact with the first side of the roller, and by the supply of ink provided on the second side (e.g., the roller rolling through a reservoir area).

The operations of this process are depicted in the drawing in a particular order for simplicity, but some of the operations shown are in fact performed in parallel with each other. Sequential ordering of operations is not required, and not all of the illustrated operations need be performed to achieve desirable results. The transporting at 400 can involve continuously moving the band at a same speed as the substrate, in coordination with the actuating, to achieve a pack rate above 650 packs per minute (ppm), although some implementations can be operated at pack rates of 650 ppm or less.

For a traditional spool-to-spool type thermal transfer printer, the rate of acceleration for the direction changes of the spools and ribbon is dictated by the fact that the motors should not lose position while accelerating the mass of the ribbon rolls, which thus limits the pack rate. The supply and take-up spools are accelerated until the linear speed of the ribbon matches the speed of the substrate, the printhead is actuated, the printhead prints, the printhead is retracted, and the spools of ribbon are decelerated, stopped, accelerated in reverse, decelerated and stopped in the start position in preparation for the next print. The mass of the ribbon spools limits the acceleration and deceleration of the ribbon spool motors. This adds considerable time between prints for the printer to prepare for the next print which is what limits the pack rate. For example, the pack rate for printing a 20 mm print at 1 m/s with a traditional spool-to-spool type thermal transfer printer is about 172 ppm.

In contrast, with the re-inked band described herein, there need only be one motor that always drives the band in one direction. The pack rate is thus limited to how quickly the printhead can be actuated. With high abrasion resistant printheads, or with a low friction treatment (such as with a Teflon® material) to the printhead side of the re-inked band, there is a possibility that the printhead does not need to be lifted between prints. In this case the pack rate is only limited by the data transfer rate to the printhead.

Note that the print speed is the rate at which the head can print once the head is contacting the ribbon and substrate. The print speed is limited by the ability for the resistors in the printhead to heat and cool. Pack rate is related to how quickly the printer can prepare for the next print. For a traditional shuttled printer (where the shuttle has lower inertia than the mass of a roll of ribbon), for each print, the shuttle is accelerated to the speed of the substrate, the printhead is actuated, the printhead prints, the printhead is retracted, the shuttle is reversed to the start position, and the cycle starts again. Additionally, the length of travel of the shuttle also limits the length of the print. Current shuttle-type thermal transfer printers can achieve a pack rate of about 474 ppm.

With the re-inked band, the band can be run constantly in one direction and be controlled to match the speed of the substrate. The pack rate may thus be limited only by the actuation time of the printhead. Once the printhead is retracted, there need be no other mechanism that must be returned to a start position. The length of the print doesn't have to be limited by the travel distance of a shuttle. In some implementations, a pack rate of 845 ppm can be readily achieved. Moreover, in some implementations, where the printhead is down at all times, thus allowing essentially back-to-back printing, the pack rate can approach 4000 ppm.

Embodiments of the subject matter and the functional operations described in this specification can be implemented using digital electronic circuitry, computer software, firmware, or hardware, including the structures disclosed in this specification and their structural equivalents, or in combinations of one or more of them. Embodiments of the subject matter described in this specification can be implemented using one or more modules of computer program instructions encoded on a computer-readable medium (e.g., a machine-readable storage device, a machine-readable storage substrate, a memory device, or a combination of one or more of them) for execution by, or to control the operation of, data processing apparatus. The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

While this specification contains many implementation details, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular embodiments of the invention have been described. Other embodiments are within the scope of the following claims. For example, a system can employ a print platform to transport the substrate rather than a print roller. A system can employ a foam or sponge roller impregnated with hot melt ink and put in contact with the heated ink roller to supply ink. A system could reduce the number of guide rollers or guide the re-inked band by another mechanism, such as a rotating drum. A system could use a nip roller in conjunction with the drive roller to move the re-inked band. A system could use the force between the ribbon, pressed by the printhead, against the moving substrate to move the re-inked band in conjunction with or without the drive motor. Moreover, the actions recited in the claims can be performed in a different order and still achieve desirable results.

What is claimed is:

1. A printing apparatus comprising:

a band of material capable of holding hot melt ink thereon;

rollers configured and arranged to hold and transport the band with respect to a substrate;

a printhead configured and arranged to thermally transfer a portion of the ink from the band to the substrate to print on the substrate; and a heated ink roller comprising a solid heat conducting material having an outer surface that is textured, wherein a first side of the heated ink roller contacts the band to cause ink on the band to re-melt, flow and replace at least some of the portion of the ink transferred to the substrate previously before arriving at the printhead again for a next print, and a second side of the heated ink roller receives new ink on the textured outer surface;

wherein the band of material is selected to provide a heat transfer rate greater than 0.12 Watts/meter-Kelvin, and a thickness of the band of material is less than 25 microns.

2. The printing apparatus of claim 1, wherein the band of material comprises an engineering plastic.

3. The printing apparatus of claim 1, wherein the band of material comprises a metal ribbon, and the thickness of the band of material is less than 10 microns.

4. The printing apparatus of claim 3, wherein the metal ribbon comprises a stainless steel ribbon, and the thickness is 5 microns.

5. The printing apparatus of claim 1, wherein the textured outer surface of the ink roller has a surface roughness greater than or equal to 3.2 microns, and the printing apparatus comprises a blade configured and arranged to control an amount of ink retained by the textured outer surface of the ink roller, such that a uniform coating of ink, between 3 and 7 microns thick, is applied to the band.

6. The printing apparatus of claim 5, comprising an additional blade configured and arranged to keep debris from rolling into an ink supply for the ink roller.

7. The printing apparatus of claim 1, wherein one of the rollers configured and arranged to hold and transport the band is a drive roller, and another of the rollers configured and arranged to hold and transport the band is a spring loaded tension roller, and the band is kept at approximately 6 Newtons of tension.

8. The printing apparatus of claim 7, comprising a nip roller used in conjunction with the drive roller to move the band.

9. The printing apparatus of claim 1, comprising a control system configured to control the band to match a speed of the substrate and to print at a pack rate above 650 packs per minute.

10. A method comprising:

transporting a band holding hot melt ink thereon in proximity to both a heating device and a thermal transfer printhead, where the thermal transfer printhead is adjacent to a substrate;

actuating heaters in the thermal transfer printhead to transfer a portion of the ink from the band to the substrate to create a print on the substrate;

using a heater to maintain a temperature of a solid heat conducting material of an ink roller, wherein the solid heat conducting material includes a textured outer surface;

applying a first side of the ink roller to the band to cause ink on the band to re-melt, flow and replace at least some of the portion of the ink transferred to the substrate previously before arriving at the printhead again for a next print;

supplying new ink to a second side of the ink roller, wherein the textured outer surface of the ink roller has a surface roughness greater than or equal to 3.2 microns, and the textured outer surface of the ink roller retains the new ink; and using a blade to control an amount of ink retained by the textured outer surface of the ink roller, such that a uniform coating of ink, between 3 and 7 microns thick, is applied to the band.

11. The method of claim 10, wherein the supplying comprises periodically putting solid ink in contact with the textured outer surface of the ink roller.

12. The method of claim 10, comprising using an additional blade with the ink roller to keep debris from rolling into an ink supply.

13. The method of claim 10, wherein the transporting comprises continuously moving the band with a single motor, in a single direction, at a same speed as the substrate, in coordination with the actuating, to achieve a pack rate above 650 packs per minute.

14. The method of claim 10, comprising:

moving the thermal transfer printhead from a non-printing position into a printing position against the band to press the band against the substrate before the actuating;

moving the thermal transfer printhead back into the non-printing position after the actuating; and using a nip roller in conjunction with a drive roller to move the band.

15. The method of claim 10, comprising keeping the band at approximately 6 Newtons of tension.

16. The method of claim 10, wherein the band comprises a polyimide film, an engineering plastic, or a metal ribbon.

17. A method comprising:

selecting a thickness for a band of material based on heat transfer characteristics through the material formed into the band; and providing the band in a printing apparatus comprising a printhead, a heated ink roller, a first blade, and a second blade;

wherein the heated ink roller has an outer surface that is textured and contacts the band to heat the band, thereby causing ink on the band to re-melt and flow, and the textured outer surface receives new ink from an ink reservoir for addition to the band;

wherein the first blade is configured and arranged to doctor the ink on the outer surface of the heated ink roller, and the second blade is configured and arranged to keep debris from rolling into the reservoir;

wherein the selected thickness for the band provides durability for the band, and quality prints using the ink re-melted to flow on the band, at print pack rates above 650 packs per minute.

18. The method of claim 17, wherein providing the band in the printing apparatus comprises keeping the band at approximately 6 Newtons of tension.

19. The method of claim 17, comprising providing a motor that always drives the band in one direction.

20. The method of claim 17, comprising using a nip roller in conjunction with a drive roller to move the band.

* * * * *